US005388716A

United States Patent [19]

Stoffel et al.

[11] Patent Number: 5,388,716

[45] Date of Patent: Feb. 14, 1995

[54] CONTAINER FOR PRESSURE-TIGHT DISPENSERS AND METHOD FOR MANUFACTURE OF THE SAME

[75] Inventors: Hans F. Stoffel, Zurich; Oskar Frey, Hinwil; Gerhard Obrist, Kaiseraugst, all of Switzerland

[73] Assignee: Prazisions-Werkzeuge AG, Switzerland

[21] Appl. No.: 115,676

[22] Filed: Sep. 2, 1993

Related U.S. Application Data

[63] Continuation of Ser. No. 836,972, Feb. 19, 1992, abandoned.

[30] Foreign Application Priority Data

Feb. 19, 1991 [CH] Switzerland ..... 505/91

[51] Int. Cl.[6] ..... B65D 25/16

[52] U.S. Cl. ..... 220/404; 220/723

[58] Field of Search ..... 220/404, 403, 415, 720, 220/723

[56] References Cited

U.S. PATENT DOCUMENTS

| | | | |
|---|---|---|---|
| 3,052,371 | 9/1962 | Bemmelen | 220/404 |
| 3,443,735 | 5/1969 | Meijers | 220/404 |
| 3,777,925 | 12/1973 | Eckholm | 220/404 |
| 3,784,049 | 1/1974 | Hawk | 220/404 |
| 3,964,630 | 6/1976 | Getz | 220/404 |
| 4,293,353 | 10/1981 | Pelton et al. | 220/404 |
| 4,308,973 | 1/1982 | Irland . | |
| 4,459,793 | 7/1984 | Zenger | 220/404 |

FOREIGN PATENT DOCUMENTS

| | | |
|---|---|---|
| 0017147A1 | 10/1980 | European Pat. Off. . |
| 354137 | 2/1990 | European Pat. Off. . |
| 4187724A1 | 3/1991 | European Pat. Off. . |
| 175286 | 4/1971 | Germany . |
| 3808438 | 4/1989 | Germany . |
| 591997 | 10/1977 | Switzerland . |

*Primary Examiner*—Joseph Man-Fu Moy

*Attorney, Agent, or Firm*—Wigman, Cohen, Leitner & Myers

[57] ABSTRACT

Double-walled container for pressure-tight dispensers, having a cup-shaped inside container and a one-piece outside container is disclosed. The neck attachment of the flask-like outside container is provided with an inverted zone by which an annular groove is formed inside the outside container and the inside container is adhesively secured within the groove. Also disclosed is a method for producing such a double-walled container which includes the steps of positioning the inside container into the cylindrical outside container, shaping the outside container at the upper portion into a flask-like shape without deforming the inside container, and securing the inside container into the groove formed by the deformation.

25 Claims, 4 Drawing Sheets

CONTAINER FOR PRESSURE-TIGHT DISPENSERS AND METHOD FOR MANUFACTURE OF THE SAME

This is a continuation of application Ser. No. 07/836,972, filed on Feb. 19, 1992, now abandoned.

BACKGROUND OF THE INVENTION

1. Field of the Invention

The present invention relates generally to a double-walled dispenser container which is free of a discharge opening and is pressure-tight. More particularly, the present invention which is used for the delivery of flowable products, especially cosmetic products, comprises a one-piece flask-like outside container and a compressible inside container. A method for manufacture of the subject container is also described.

Containers of the aforementioned type are most preferred by the cosmetic and material industries, in which pressure-resistant spray cans and dispensers are called for in ever greater measure, for packaging their liquid, soft paste, cream or gel products. Containers in which the propellent gas is separated from the filler material are very important today for various reasons. On the one hand, the propellent gases used traditionally in aerosol containers, which are generally flammable, for instance, butane, propane, etc., do not leak out to the outside with these tight containers. On the other hand such containers now also allow the use of propellent gases which in contact would chemically modify the packaged products, such as for instance compressed gases, particularly air, nitrogen, carbon dioxide, etc.

Therefore the packaging industry endeavors to manufacture pressure-tight containers which also have a long life and can still be manufactured at low cost.

2. Description of the Prior Art

Double-walled containers as they are already known from U.S. Pat. No. 4,308,973 and European Patent A-017,147, consist of a container and a cover, in which the container is essentially composed of a cylindrically shaped outer wall with an inserted inner wall having a discharge opening built onto these container parts, which supports the cover or respectively the valve attachment. Traditionally, the cylindrically shaped outer wall is manufactured of tin plate or aluminum, while the inner wall is aluminum or plastic. Aluminum or tin plate can also be used for the cover or respectively the valve attachment. It is to be understood that a container constructed in this manner can be manufactured and maintained only at considerable cost.

However it has been shown that the container constructed in three parts does not remain pressure-tight over a long period and its constancy of performance is insufficient after long use. These sealing problems are principally inherent in this type of product and arise from the mode of construction of these containers, in which the outside container is flanged over and subsequently beaded together with the inside container and the discharge opening on its opening edge. This type of joining of different solid materials cannot in a satisfactory manner withstand the increased stress of a container of, for instance 250 ml or more, which is under pressure. The counterflow movement of the different solid materials because of the edge beading or sealing leads to nonuniform regions in the joining materials in this area.

Another container has also already been made known in which the traditional discharge opening part and the cylindrical outside wall part are replaced by a one-piece outside container, in which the inside container has a collar which rests on the rolled edge of this outside container and is fastened there only upon setting and clamping of the valve cover. For the same reasons earlier mentioned, this construction cannot overcome the aforementioned sealing problems and it also gives rise to certain technical manufacturing drawbacks. The inside container must be deformed and be forced through the small container opening provided for the valve cover. Not only is this procedure costly, but also the inside container can become damaged, which need not be discussed in any greater detail at this point.

A double-walled container in which the inside container and the outside container are pushed together one into the other without deformation is also known, wherein the two edges are joined and are drawn in and beaded together. The drawing together, including the tapering of both of the cylindrical container parts, however, is possible only with use of expensive and particularly accident-causing tools. Thus, the beading of the joined points leads to technical difficulties and sets extraordinary conditions on the method for manufacture of such two-part containers.

SUMMARY AND ADVANTAGES OF THE PRESENT INVENTION

The present invention addresses this situation and describes a container of the aforementioned type but one which does not have the problems associated with conventional containers.

The double-walled container of the present invention can be used as a pressure-tight dispenser which is much better than that of the presently used dispensers, and which can be manufactured at low cost, and also, following lengthy or multiple uses, does not show great fatigue and wear. In other words, the container of the present invention has superior pressure-withstanding properties which do not diminish over time.

The double-walled container according to the present invention comprises an outside wall of one piece, having a shape which corresponds to that of an upward-tapering vessel with a narrow opening. In the tapering region of this outside container wall, the neck attachment, at least one annular inverted zone is provided, and the foldover of the inverted zone projects into the inside chamber of the outside container wall so that the inverted zone together with the outside container wall forms an annular groove in the inside chamber, which is open toward the side of the outside container turned away from the tapering area. An essentially cup-shaped inside container wall is fastened in this groove.

Because of the special construction of this container, only two joined members are therefore required for the manufacture of the pressure-tight container. First, the inside container wall is joined with the outside container wall. Second, the outside container wall is joined with the valve cover, whereupon an absolutely pressure-tight and operationally constant container can be manufactured in a simple and relatively inexpensive manner.

The advantages of the container according to the present invention include the constancy of performance and long life of pressurized dispensers manufactured with use of these containers as well as the technical manufacturing aspects.

The materials used for the manufacture of the present invention are advantageously pressure-resistant, gas-impermeable, corrosion-reisistant and simple to maintain. Thus, aluminum can be used for the compressible inside container, the pressure-tight outside container and also the valve cover. The pressure-resistant joining of materials of the same type offers no difficulties to the expert in the art. In one preferred embodiment, a suitable material particularly selected for introduction into and hardening in the groove formed by the indentation is any suitable adhesive or bonding material, such as an epoxy-type, or, a polymer modified with carboxyl groups.

In another preferred embodiment, the surface of the inside container wall is treated or coated with lacquer, or other suitable coating resin to avoid the possiblity of a chemical reaction between the material of the inside container and the filler material.

The chamber of the container holding the filler material is at least partially coated with a lacquer or varnish, plastic or some other suitable protective film.

The method of manufacture of the container according to the invention leads to the surprising result that the inside container need not be either especially preformed or postformed which is a costly procedure, and that a performance-constant, two-part container can still be obtained.

Characteristic of the manufacture of the container according to the invention is a first step of the method wherein the cup-shaped inside container is inserted in the still unshaped outside container, so that the bottom parts of these two container parts lie adjacent to each other. The axial expansion of the inside container is of smaller magnitude than that of the outside container. The part of the outside container projecting over the inserted inside container is now shaped in the second step of the method according to the invention, while the inside container is not deformed. In a third step of the method, the top edge of the inside container is pushed into the groove formed on the outside container according to the invention and is secured by a suitable sealant or adhesive.

In one preferred embodiment, the part of the outside container forming the groove is additionally deformed and is positioned against the tapering part of the outside container.

Ancillary thereto, the part of the container forming the groove can be provided with an outside slot running around the container, especially to additionally secure the inside container.

In a further devlopment of the method according to the invention the inside container coming into contact with the filler material is at least partially coated with a suitable protective film. This coating facilitates making the container also suitable for carrying fluids, such as, silicone sealants or lubricants, as well as, for products from the food and pharmaceutical industries.

BRIEF DESCRIPTION OF THE DRAWINGS

Hereinafter the invention will be described in greater detail relative to exemplary embodiments and with the aid of the drawings, wherein.

FIGS. *4a–4d* are various embodiments of the container formed according to the present invention.

DETAILED DESCRIPTION OF THE PREFERRED EMBODIMENTS

Prior Art

Figure 1:
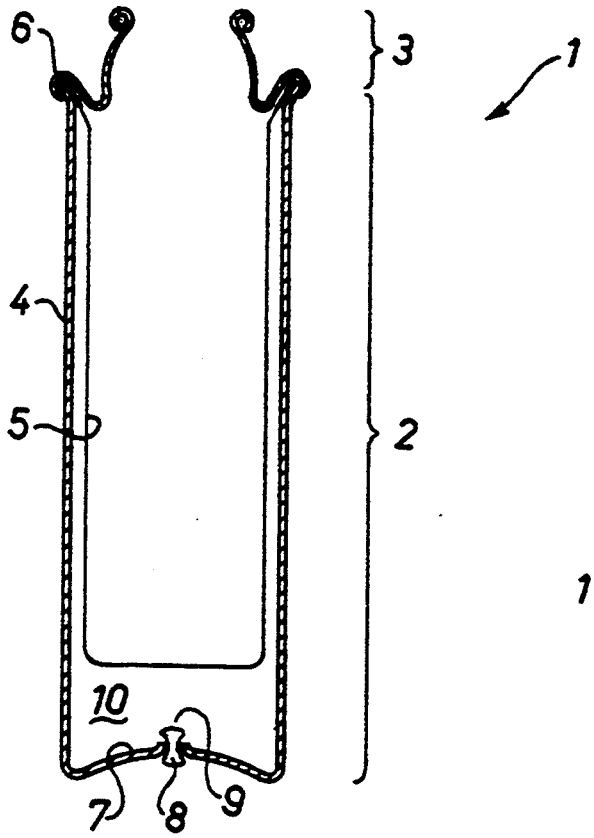
Fig. 1 (PRIOR ART)
FIG. 1 is an elevational view of a transverse section taken through the bottom part of a conventional three-part dispenser.

The three-part conventional container 1 shown in FIG. 1 includes a double-walled container 2 and a discharge opening 3, wherein double-walled container 2 consists essentially of an outside container 4 and an inside container wall 5. Outside container 4 is manufactured of pure aluminum and is drawn into a cylindrical shape without seams. The top container border is constructed as a flange, in order to be flanged and beaded together with inside container 5 and discharge opening 3. The base 7 of outside container 4 is curved inward and is provided with a bottom aperture 9 intended to receive a plug 8. Inside container 5 introduced into outside container 4 is also made of pure aluminum, and, by a special method, for instance soft annealing, and in a predetermined manner, is brought into a collapsible state. The joining occurs in the bead 6 between outside container 4 and discharge opening 3. This discharge opening 3 is traditionally made of a tin plated steel sheet, but can also be made of aluminum. Container 1 constructed in such a manner, is covered with a prefabricated valve member following filling in of the product to be packaged. Then, the valve plate is clamped together with the discharge opening part. Some desired pressure medium is introduced into the intermediate space 10 between outside container 4 and inside container 5 and is held therein with plug 8.

Figure 2:
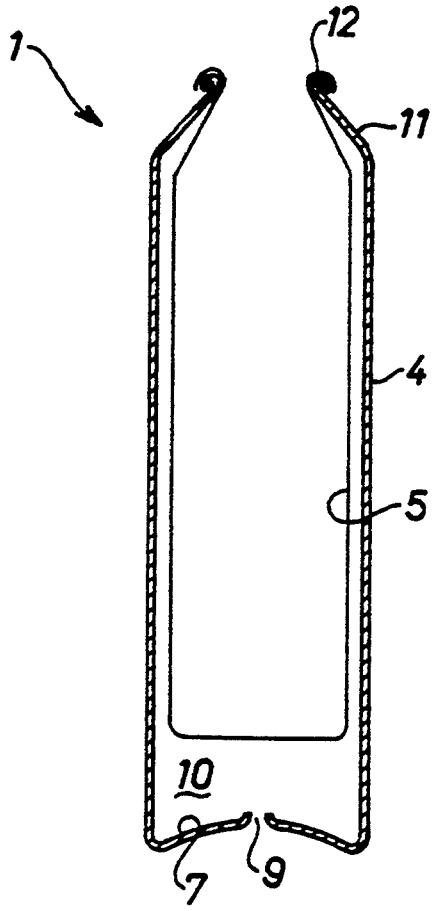
Fig. 2 (PRIOR ART)
FIG. 2 is an elevational view of a transverse section taken through the bottom part of a conventional two-part dispenser.

FIG. 2 shows a conventional two-part container 1 in which the discharge opening 3 is replaced by a shoulder 11 of the container constructed in one piece with outside container 4. Inside container 5 in this container 1 is a flexible plastic, for instance a suitable polyethylene, in order to allow the use of this inside container 5 without noticeable damage. After insertion of inside container 5, a preshaped collar 12 of inside container 5 is tightly fitted onto the top edge of outside container 4. To tightly close the filled bottom part of dispenser 1, the top edge of outside container 4 is clamped with a commercial aluminum or sheet metal valve. It will be appreciated that the simultaneous clamping or beading of three different materials intended to serve for a long time is not easily accomplished with this complex construction.

The Present Invention

Figure 3:
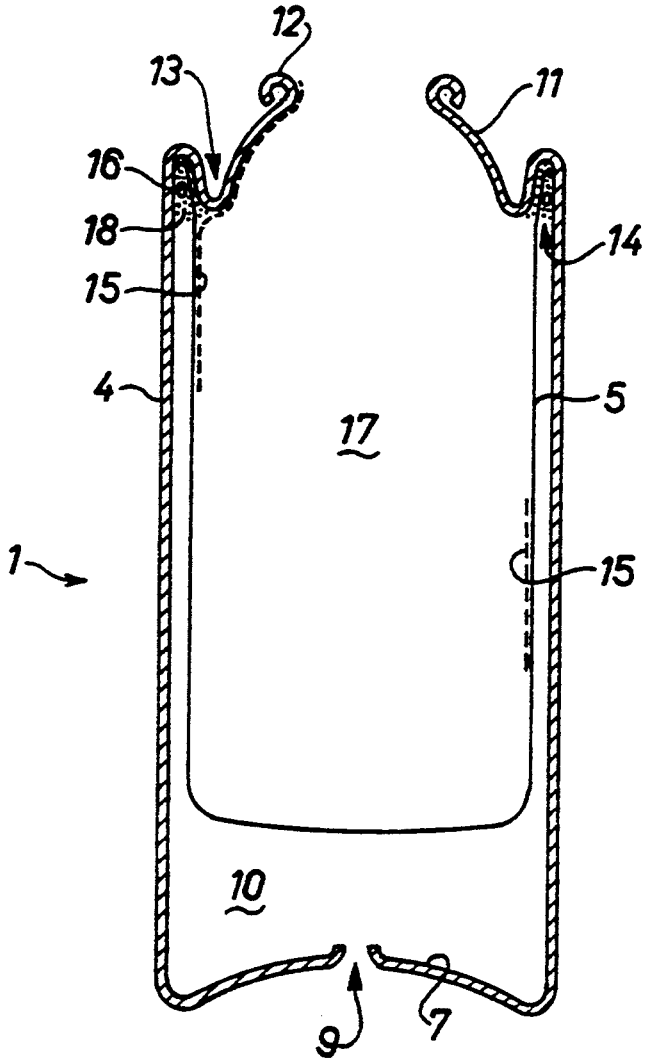
FIG. 3 is an elevational view of a transverse section taken through a container according to the present invention.

A container 1 is shown in FIG. 3 in which discharge opening 3 is replaced by suitable shaping of outside container 4. Container 1 according to the invention in this case includes only two structural parts; a specially formed outside container 4 and one inside container 5. The shaping of outside container 4 is such that an annular inverted zone 13 lies in the area of the neck attachment of flask-like outside container 4. This inverted zone 13 is aligned so that an annular groove 14 is formed in the inside chamber of outside container 4. The top edge of inside container 5 is secured in this groove 14. It is to be understood that any suitable sealant or adhesive can be used for fastening the top of container 5 and in any case this sealant or adhesive can be hardened in a controlled manner by application of high frequency, heat induction, or the like. Other fastening means, especially means including providing further deformations of the groove and then adapting the manufacturing method correspondingly, may be employed.

In one preferred embodiment both outside container 4 and compressible inside container 5 are aluminum and an expanding epoxy base adhesive is used for their mutual fastening. Such adhesives are well known to those skilled in the art and need not be further explained. In this preferred embodiment (FIG. 3), the outside container has an inward-curved base 7. An aperture 9 provided in this base 7 serves for introduction of the desired pressure medium into the intermediate space 10 formed by inside container 5 and outside container 4. This pressure medium should be able to exert a pressure of up to 21 bar without causing leakage from outside container 4. Insider container 5 in this preferred embodiment is of soft aluminum, sometimes referred to a "tube material" which can be additionally treated in any desired manner for certain purposes. For example, container 5 can be provided with a protective coating 15 as described in detail in European Patent A-418,724, and incorporated herein by reference, to prevent any chemical reaction with the filler material. It is to be understood that it is advantageous that inside container 5 also be manufactured of a product-compatible plastic.

In one further development of the container according to the invention, cup-shaped inside container 5 is widened somewhat in the area of its opening and even has a rolled border. Thus inside container 5 can be positioned at some distance from the outside container and be fastened even more securely in groove 14. As a result of the distancing of the two container parts from each other the ratio between the volume of intermediate space 10 and the volume of inside container 5 can be modified in a simple manner, in other words can be adpated to the wishes of the manufacturer of the dispenser. Dispensers in use today have such a volume ratio of 36:64.

Figure 4A:
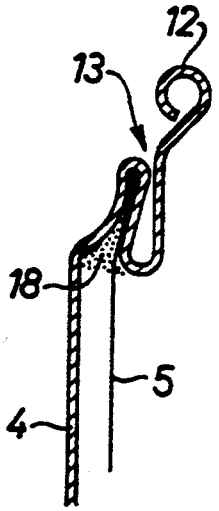
Figure 4B:
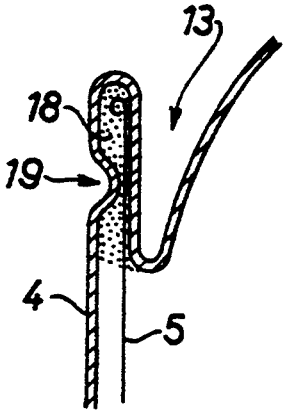
Figure 4C:
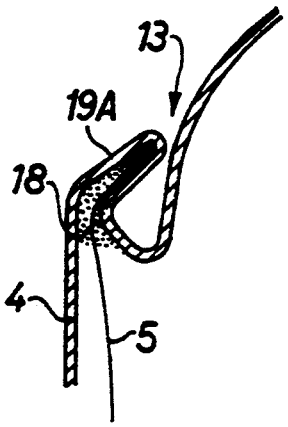
Figure 4D:
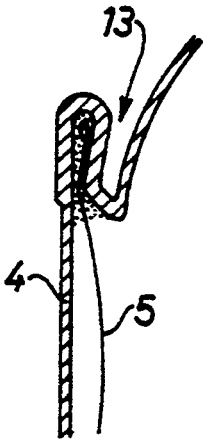

FIGS. 4*a*–4*d* show additional preferred embodiments of the shape of groove 14 of container 1. As is shown in FIGS. 4*a* and 4*c*, this can engage on the tapering part of outside container 4, or have a slot 19 running around the dispenser, as is shown for instance in FIG. 4*b*. It is to be understood that an O-ring can also be fixed in groove 14 for improved fixing and stabilization, and/or the wall thickness of the parts to be joined together can be increased at least in this particular area.

Figure 5:
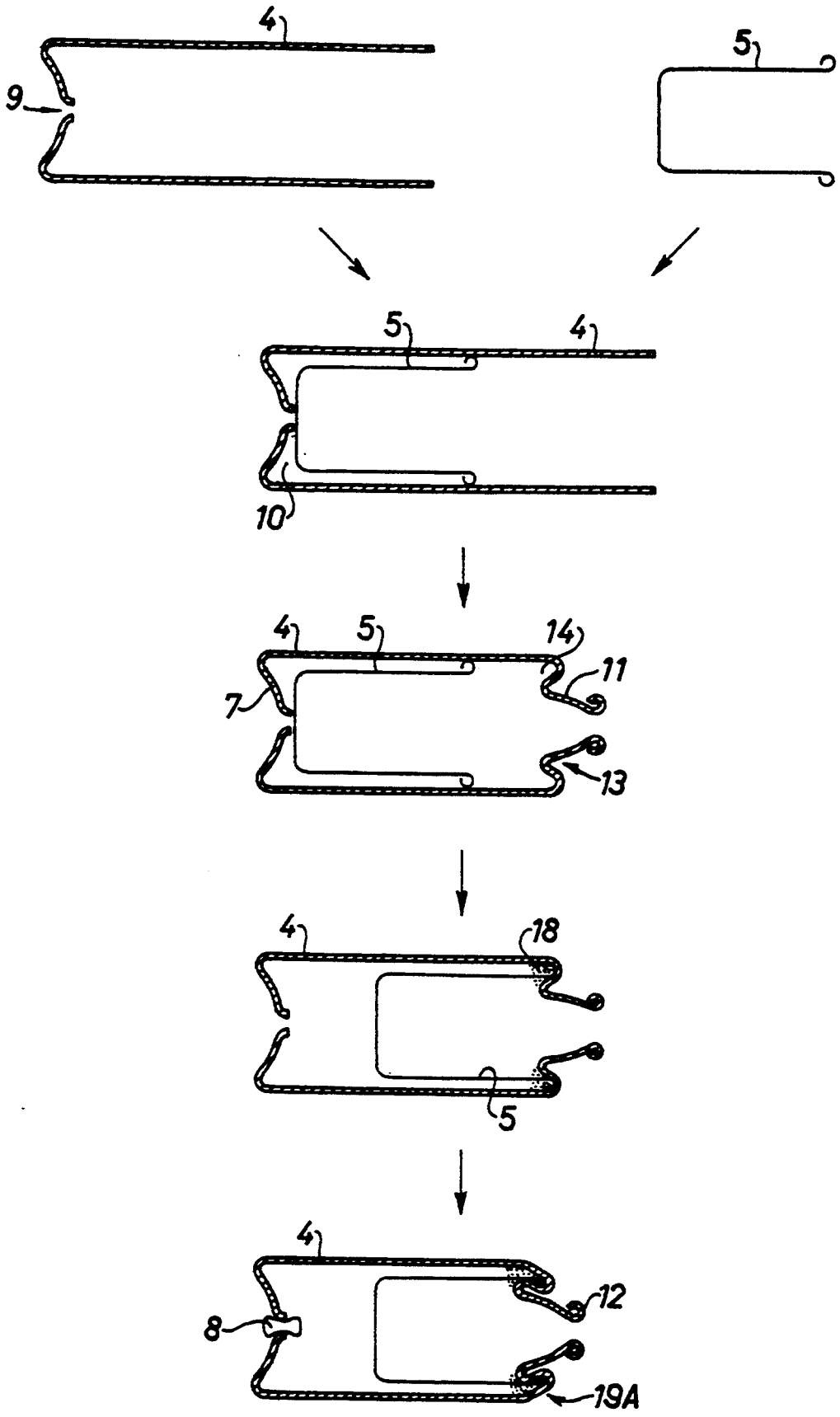
FIG. 5 is a diagrammatic representation of the method of manufacture of the container according to the present invention.

The essential setps of the method for manufacture of a container according to the invention are shown diagrammatically in FIG. 5. Starting with a first cylindrical container 4 and a second cup-shaped container 5, second container 5 is pushed into first containter 4. The geometric dimensions of the two containers 4 and 6 are adapted to one another and normally correspond to the average of the meansurements of commercial dispenser cans, in other words, 170 mm high by 40 mm diameter for 125 ml cans, and, 200 mm high by 50 mm diameter for 255 ml cans. It is important however that the axial expansion of inside container 5 be at least of sufficiently lower magnitude than that of outside container 4 that outside container 4 can be shaped in a second step of the method without thereby deforming inside container 5. This longitudinal differential is approximately 20 mm in the preferred exemplary embodiment.

For the third step of the method, inside container 5 is pushed against the opening until its edge lies in groove 14 and is fastened therein. Ancillary thereto, in the part of outside container 4 adjacent groove 14, a slot 19 (FIG. 4*b*) or other deformation 19A (FIG. 4*c*) is now formed on the outside, running around the dispenser, so that inside container 5 can no longer slip out of groove 14 with its top border. For the permanent fastening of container 4, a suitable adhesive means 18 is introduced into groove 14. It has been shown to be particularly advantageous to allow an easily flowing adhesive, especially an adhesive with a viscosity of 500 poise, to flow through aperture 9 in base 7 into groove 14 of outside container 4 over the slightly concave base of inside container 5, until groove 15 is filled. However, it is also to be understood that the adhesive can also be guided through the aperture of the valve of the outside container and can be introduced therein before inside container 5 is introduced into groove 14.

The advantages of the present method of manufacture which has been described herein are readily apparent. For example, container 5 need not now be subjected to unnecessary deformation and outside container 4 need no longer be connected with an outside discharge opening 3. The user is free to apply another protective coating 15, as described in European Patent A-418,724, in chamber 17 coming in contact with the filler material.

It is to be understood that the present invention is not limited to the above exemplary embodiment, but that many further modifications in the construction of outside container 4, especially concerning the fastening together of containers 4 and 5, lie within the knowledge of persons skilled in the art. For instance, groove 14 can be further reinforced, or desirable coatings can be applied in order to make the containers product-compatible. Structural components manufactured of the same material especially allow all undesired metal reactions to be avoided, such as occur with commercial cans.

The containers according to the invention are thus characterized by a low-cost method of manufacture and high lifetime stability, or, in other words, high performance.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. Double-walled container for a dispenser which is pressure-tight and includes a chamber therein for delivery of flowable products, said container comprising a seamless outside container of one piece construction and a compressible inside container, said compressible inside container having a top and an opening at said top and being cup-shaped, said outside container being made of metal and having a wall having outer and inner surfaces, an opening for receiving a valve closure, an inside chamber and an annular inverted zone formed by deformation of said outer and inner surfaces in an upper portion of said wall, displaced from said opening for receiving a valve closure, thereby forming a seamless circumferential groove inside said outside container and a neck portion extending from said seamless circumferential groove to said valve closure receiving opening, said inside container is fastened along the top thereof in the seamless circumferential groove in the inside chamber of the outside container, independent of said opening for receiving a valve closure, thereby forming an attachment between said inside container and said outside container that is seamless on said outside container outer surface and eliminating leakage directly from said inside container to the outside of said double-walled container.

2. Double-walled container as recited in claim 1, wherein the inside container is adhesively secured in the circumferential groove.

3. Double-walled container as recited in claim 1, each said wall having a wall thickness, wherein the wall thickness of one of the containers selected from the group of containers consisting of the outside container and the inside container is increased in the region of their being fastened together.

4. Double-walled container as recited in claim 2, wherein the top edge of the inside container is beaded.

5. Double-walled container as recited in claim 2, wherein the chamber receiving the flowable products is partially coated with a protective layer.

6. Double-walled container as recited in claim 2, wherein the upper portion of the outside container forming the circumferential groove is deformed to further secure the inside container positioned in said groove.

7. Method for the production of a double-walled container portion for a dispenser which is pressure-tight and includes a chamber therein for delivery of flowable products, said container comprising an outside container of one piece construction and a compressible inside container, comprising the steps of:

providing a substantially cylindrical first container having a seamless continuous wall having an outer surface and an inner surface, said container having an opening at the top thereof for receiving a valve closure;

introducing a second, cup-shaped container into said first container, said second container having a top edge and an axial expansion, the axial expansion of said second container being at least of sufficiently lower magnitude than that of the outside container such that the outside container can be thereafter shaped without deforming the inside container;

shaping the first container by deforming the first container to form a flask-like portion in the region of the opening thereof, without deforming the second container positioned inside the first container, said outside container being shaped to form an annular inverted zone in the tapering region of the flask-like outside container by deforming said seamless continuous first container wall, said inverted zone projecting into the inside chamber of the outside container so that the inverted zone together with the undeformed wall part of the outside container forms a seamless annular groove in the inside chamber, which is open to the side turned away from the tapering region, said inverted zone located at a distance displaced from said opening for receiving a valve closure, positioning the second container so that its top edge fits in said seamless annular groove; and adhesively securing said second container in said seamless annular groove of said first container independent of attachment of a valve closure to said opening for receiving said valve closure.

8. The method of claim 7, further including the step of deforming the upper wall portion of the outside container opposite said groove toward said inner container.

9. The method of claim 7, further including the step of introducing a fluid adhesive into said groove.

10. The method of claim 7, further including the steps of precoating the inner and outer container walls with a protective coating or resin.

11. In a dispenser of fluids, pharmaceuticals or foods including a double-walled container portion, said dispenser having a valve serving as a discharge opening, said dispenser for the delivery of a flowable product under pressure from a propellant gas, said double-walled container portion comprising:

an outside container, and an inside container;

said outside container being made of metal and being of one piece construction having a seamless continuous wall having an outer surface and an inner surface sealably interrupted for receiving a charge of propellant gas and having an open top for receiving and attachment to said valve, and having an annular inverted zone formed in said wall outside of said outside container by deforming said wall at a location displaced from said open top, thereby forming a seamless circumferential groove inside of said outside container and a neck portion extending from said seamless circumferential groove to said open top for receiving and attachment to said valve, said inside container being compressible and having a continuous wall, cup-shaped with an open top, said inside container being fastened along the top thereof in said seamless circumferential groove inside of said outside container and independent of said discharge opening, thereby forming an attachment which is seamless on said outside container outer surface and is attached to said outside container independent of attachment of said valve to said outside container, wherein said inside container fastened to said outside container thereby forms an intermediate space between said wall of said outside container and said wall of said inside container for containing a propellant gas charge and a chamber for containing a flowable product to be dispensed by the dispenser.

12. A dispenser container adapted to receive a valve serving as a discharge opening, said dispenser for delivering a flowable product under pressure from a pressure medium, said container comprising:

an outside container; and an inside container;

said outside container being made of metal and being of one piece construction and having a seamless continuous wall with inner and outer surfaces and an open top for receiving and attachment to a discharge valve, an annular inverted zone formed in said outer surface of said wall by deforming said wall at a location displaced from said open top, thereby forming a seamless circumferential groove in said inner surface of said wall and a neck portion extending from said seamless circumferential groove to said open top for receiving and attachment to said valve, said inside container being compressible and having a continuous wall, with an open top and having inner and outer surfaces;

said inside container being circumferentially secured along the top thereof within said seamless circumferential groove of said outside container to form a pressure-tight seal between said inside container and said outside container independent of said discharge valve, thereby forming an attachment which is seamless on said outside container outer surface and is independent of attachment of said discharge valve to said dispenser container, wherein said outside container and said inner surface of said inside container form a chamber for said flowable product; and wherein further an annular intermediate space is formed between said inner surface of said outside container and said outer surface of said inside container, adapted to receive a pressure medium for dispensing said flowable product.

13. A dispenser container as in claim 12, wherein said container intermediate space is adapted to receive a pressure medium in the form of a propellant gas.

14. A dispenser container as in claim 12, wherein said wall of said outside container includes a hole therein for receipt of a charge of a propellant gas to said intermediate space.

15. A dispenser container as in claim 12, wherein said wall of said outside container has a profile which is continuous, varying only in thickness and having contours provided by bending said wall.

16. A dispenser container as in claim 12, wherein said inside container is sealed to said outside container by an adhesive.

17. A dispenser container as in claim 12, wherein said inside container is sealed to said outside container by mechanical attachment of said inside container top to said circumferential groove.

18. A dispenser container as in claim 12, wherein said inside container is cup-shaped.

19. A dispenser container, said dispenser for delivering a flowable product under pressure from a pressure medium, said container comprising:

an outside container;

an inside container;

said inside container being compressible and having a continuous wall, with an open top having a terminal edge portion and having inner and outer surfaces;

said outside container being made of metal and being of one piece construction and having a wall with inner and outer surfaces and an open top for receiving and attachment to a valve closure, an annular inverted zone formed in said outer surface of said wall at a location displaced from said open top, thereby forming a circumferential groove in said inner surface of said wall sufficiently large to receive said terminal edge portion of said inside container and a neck portion extending from said circumferential groove to said open top for receiving and attachment to said valve closure;

said inside container being circumferentially secured along the terminal edge portion thereof within said circumferential groove of said outside container by an adhesive continuously positioned in said groove in an amount sufficient to cover inner and outer surfaces of said terminal edge portion of said inside container wall, thereby forming a pressure-tight seal between said inside container and said outside container independent of attachment of said valve closure to said dispenser container;

wherein said outside container and said inner surface of said inside container form a chamber for said flowable product; and wherein further an annular intermediate space is formed between said inner surface of said outside container and said outer surface of said inside container, adapted to receive a pressure medium for dispensing said flowable product.

20. A dispenser container as in claim 19, wherein said container intermediate space is adapted to receive a pressure medium in the form of a propellant gas.

21. A dispenser container as in claim 19, wherein said wall of said outside container includes a hole therein for receipt of a charge of a propellant gas to said intermediate space.

22. A dispenser container as in claim 19, wherein said wall of said outside container has a profile which is continuous, varying only in thickness and having contours provided by bending said wall.

23. A dispenser container as in claim 19, wherein said inside container is sealed to said outside container by mechanical attachment of said inside container top to said circumferential groove.

24. A dispenser container as in claim 19, wherein said inside container is cup-shaped.

25. In a double-walled container for a dispenser which is pressure-tight and includes a chamber therein for delivery of flowable products, said container comprising a seamless outside container of one piece construction and a compressible inside container, said compressible inside container having a top and an opening at said top and being cup-shaped, said outside container having a wall having outer and inner surfaces, an opening for receiving a valve closure and an inside chamber, the improvement comprising:

an annular inverted zone formed by deformation of said outer and inner surfaces in an upper portion of said outside container wall displaced from said opening for receiving a valve closure, thereby forming a seamless circumferential groove inside said outside container and a flask-shaped neck portion extending from said seamless circumferential groove to said valve closure receiving opening, and wherein said inside container is fastened along the top thereof in the seamless circumferential groove in the inside chamber of the outside container, independent of said opening for receiving a valve closure, thereby forming an attachment between said inside container and said outside container that is seamless on said outside container outer surface and eliminating leakage directly from said inside container to the outside of said double-walled container.

* * * * *